US011244798B2

(12) United States Patent
Mori et al.

(10) Patent No.: US 11,244,798 B2
(45) Date of Patent: Feb. 8, 2022

(54) CONNECTION UNIT

(71) Applicant: Omron Corporation, Kyoto (JP)

(72) Inventors: Shingo Mori, Yamaga (JP); Hiroyuki Iwasaka, Yamaga (JP); Ryota Minowa, Yamaga (JP)

(73) Assignee: Omron Corporation, Kyoto (JP)

( * ) Notice: Subject to any disclaimer, the term of this patent is extended or adjusted under 35 U.S.C. 154(b) by 104 days.

(21) Appl. No.: 16/614,160

(22) PCT Filed: Aug. 9, 2018

(86) PCT No.: PCT/JP2018/029947
§ 371 (c)(1),
(2) Date: Nov. 15, 2019

(87) PCT Pub. No.: WO2019/031588
PCT Pub. Date: Feb. 14, 2019

(65) Prior Publication Data

US 2020/0176208 A1 Jun. 4, 2020

(30) Foreign Application Priority Data

Aug. 10, 2017 (JP) ..... 2017-155928

(51) Int. Cl.
*H01H 1/00* (2006.01)
*H01H 50/42* (2006.01)
(Continued)

(52) U.S. Cl.
CPC ..... *H01H 50/42* (2013.01); *H01H 50/04* (2013.01); *H01H 50/14* (2013.01); *H01H 50/546* (2013.01)

(58) Field of Classification Search
CPC ..... H01H 50/42; H01H 50/04; H01H 50/14; H01H 50/546; H01H 50/60
(Continued)

(56) References Cited

U.S. PATENT DOCUMENTS

2013/0057369 A1* 3/2013 Yano ..... H01H 1/36 335/156
2013/0342294 A1 12/2013 Aarskog
(Continued)

FOREIGN PATENT DOCUMENTS

JP S53-155060 U 12/1978
JP 2012-199132 A 10/2012
(Continued)

OTHER PUBLICATIONS

International Search Report issued in PCT/JP2018/029947 dated Sep. 18, 2018 (2 pages).
(Continued)

*Primary Examiner* — Shawki S Ismail
*Assistant Examiner* — Lisa N Homza
(74) *Attorney, Agent, or Firm* — Osha Bergman Watanabe & Burton LLP

(57) ABSTRACT

Provided is a connection unit including an electromagnetic relay and a bus bar connected to the electromagnetic relay. In such a connection unit, a first bus bar connected to a first fixed contact terminal is disposed facing one surface of a movable touch piece located on an opposite side of the movable touch piece from the other surface of the movable touch piece in a contact-making and breaking direction, with a gap provided between the first bus bar and the movable touch piece in the contact-making and breaking direction, the first bus bar extends in a direction that intersects the contact-making and breaking direction and in which a first movable contact and a second movable contact of the movable touch piece are arranged, and at least part of the first bus bar lies over the movable touch piece in plan view in the contact-making and breaking direction.

20 Claims, 9 Drawing Sheets

(51) Int. Cl.
*H01H 50/04* (2006.01)
*H01H 50/14* (2006.01)
*H01H 50/54* (2006.01)

(58) Field of Classification Search
USPC ..... 335/196
See application file for complete search history.

(56) References Cited

U.S. PATENT DOCUMENTS

2014/0062627 A1 3/2014 Naka et al.
2015/0002250 A1 1/2015 Kashimura et al.
2015/0048908 A1 2/2015 Isozaki et al.
2016/0133410 A1* 5/2016 Bock ..... H01H 47/325 361/160
2016/0254113 A1* 9/2016 Nishimura ..... H01H 50/02 335/202
2019/0013171 A1* 1/2019 Minowa ..... H01H 50/546
2019/0131094 A1* 5/2019 Minowa ..... H01H 50/14
2019/0131095 A1* 5/2019 Minowa ..... H01H 50/443
2019/0304724 A1* 10/2019 Minowa ..... H01H 1/62
2019/0304729 A1* 10/2019 Minowa ..... H01H 50/58
2019/0311871 A1* 10/2019 Minowa ..... H01H 50/546
2020/0168408 A1* 5/2020 Mori ..... H01H 50/60
2021/0082648 A1* 3/2021 Harimochi ..... H01H 50/047
2021/0082651 A1* 3/2021 Kawaguchi ..... H01H 50/14
2021/0272763 A1* 9/2021 Mori ..... H01H 50/546
2021/0296070 A1* 9/2021 Kawaguchi ..... H01H 9/30

FOREIGN PATENT DOCUMENTS

JP 2013-084424 A 5/2013
JP 2013-084425 A 5/2013
JP 5778989 B2 9/2015

OTHER PUBLICATIONS

Written Opinion of the International Searching Authority issued in PCT/JP2018/029947 dated Sep. 18, 2018 (8 pages).

* cited by examiner

CONNECTION UNIT

TECHNICAL FIELD

The present disclosure particularly relates to a connection unit including an electromagnetic relay and a bus bar.

BACKGROUND ART

Conventionally, an electromagnetic relay that opens and closes a current path is connected to a power supply source and other electronic components through a bus bar. Examples of such electromagnetic relays include an electromagnetic relay disclosed in Patent Document 1. A description will be given of the electromagnetic relay disclosed in Patent Document 1 with reference to FIG. 18. FIG. 18 is an explanatory diagram showing a current flow in a state where the electromagnetic relay disclosed in Patent Document 1 is closed.

According to Patent Document 1, bringing a pair of contact portions 130*a* of a movable contact 130 into contact with respective fixed contacts 118*a* of fixed contacts 111 and 112 causes a current Ip to flow. Further, in the fixed contacts 111 and 112, contact conductors 115 each including the fixed contact 118*a* have a C shape and an inverted C shape, thereby generating a section where directions in which the current Ip flows through each of the contact conductors 115 and the movable contact 130 are opposite to each other. In the section, an electromagnetic repulsive force generated by the Lorentz force caused by the current Ip flowing through each of the contact conductors 115 and the movable contact 130, the electromagnetic repulsive force causing each of the contact conductors 115 and the movable contact 130 to repel each other, increases contact pressure between the pair of contact portions 130*a* of the movable contact 130 and the fixed contacts 118*a*.

PRIOR ART DOCUMENT

Patent Document

Patent Document 1: Japanese Patent No. 5778989

SUMMARY OF THE INVENTION

Problems to be Solved by the Invention

However, since a current tends to flow through the shortest path, even when the contact conductors 115 have a C shape and an inverted C shape, the current Ip does not flow through portions W, adjacent to a connecting shaft 131, of upper plate portions 116 of the C shape and the inverted C shape and only flows through portions around both ends of the movable contact 130. As a result, an electromagnetic repulsive force is generated by the Lorentz force only around both the ends of the movable contact 130. Therefore, another electromagnetic repulsive force generated between the contact portions 130*a* of the movable contact 130 and the fixed contacts 118*a* may cause the contacts to come out of contact with each other.

In light of the above-described problems, it is an object of the present disclosure to provide a connection unit that prevents contacts from coming out of contact with each other due to an electromagnetic repulsive force generated between the contacts.

Means for Solving the Problem

A connection unit according to one aspect of the present disclosure includes an electromagnetic relay, and a bus bar connected to the electromagnetic relay. In such a connection unit, the electromagnetic relay includes a case, a first fixed contact terminal fixed to the case, the first fixed contact terminal extending outward from an inside of the case and including a first fixed contact, a second fixed contact terminal fixed to the case, the second fixed contact terminal extending outward from the inside of the case and including a second fixed contact, and a movable touch piece including, on one surface of the movable touch piece, a first movable contact and a second movable contact configured to come into and out of contact with the first fixed contact of the first fixed contact terminal and the second fixed contact of the second fixed contact terminal in a contact-making and breaking direction that is a direction in which the first movable contact and the second movable contact come into or out of contact with the first fixed contact and the second fixed contact, the movable touch piece being disposed in the case and configured to move in the contact-making and breaking direction. The bus bar includes, outside the case, a first bus bar connected to the first fixed contact terminal, and a second bus bar connected to the second fixed contact terminal, the first bus bar is disposed facing another surface of the movable touch piece located on an opposite side of the movable touch piece from the one surface in the contact-making and breaking direction, with a gap provided between the first bus bar and the movable touch piece in the contact-making and breaking direction, the first bus bar extends in a direction that intersects the contact-making and breaking direction and in which the first movable contact and the second movable contact of the movable touch piece are arranged, and at least part of the first bus bar lies over the movable touch piece in plan view in the contact-making and breaking direction.

In respective regions of the first bus bar and the movable touch piece that lie over each other in plan view in the contact-making and breaking direction, a direction in which a current flows through the first bus bar extending in the direction that intersects the contact-making and breaking direction and in which the first movable contact and the second movable contact of the movable touch piece are arranged is opposite to a direction in which a current flows through the movable touch piece. As a result, a force that is applied to the movable touch piece to push the movable contacts against the fixed contacts is generated by the Lorentz force, and it is thus possible to increase contact pressure between the movable contacts of the movable touch piece, and the first fixed contact and the second fixed contact. Therefore, an electromagnetic repulsive force derived from the Lorentz force can prevent the movable touch piece from coming out of contact with the first fixed contact terminal and the second fixed contact terminal.

Effect of the Invention

According to the present disclosure, it is possible to provide the connection unit capable of preventing contacts from coming out of contact with each other due to an electromagnetic repulsive force generated between contacts.

MODE FOR CARRYING OUT THE INVENTION

A description will be given below of an embodiment of the present disclosure with reference to the accompanying drawings. In the following description, terms representing specific directions or positions (for example, terms including "up", "down", "right", and "left") are used as necessary, and note that these terms are used to facilitate understanding of the disclosure with reference to the drawings, and the technical scope of the present disclosure is not limited by the meanings of these terms. Further, the following description will be given by way of example only in nature and is not intended to limit the present disclosure, entities to which the present disclosure is applied, or uses of the present disclosure. Furthermore, the drawings are schematic illustrations, and the ratios of dimensions and the like do not necessarily match the actual ratios.

APPLICATION EXAMPLE

Figure 1:
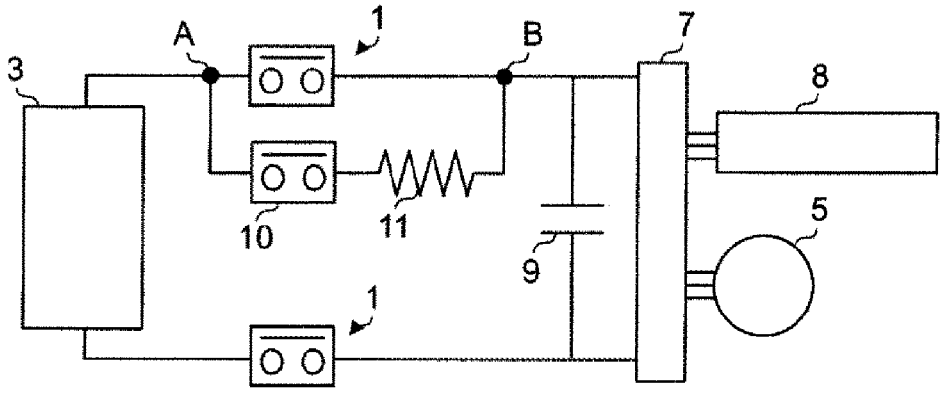
FIG. 1 is a circuit diagram schematically showing an example of an application case of a connection unit according to a first embodiment.
Figure 2:
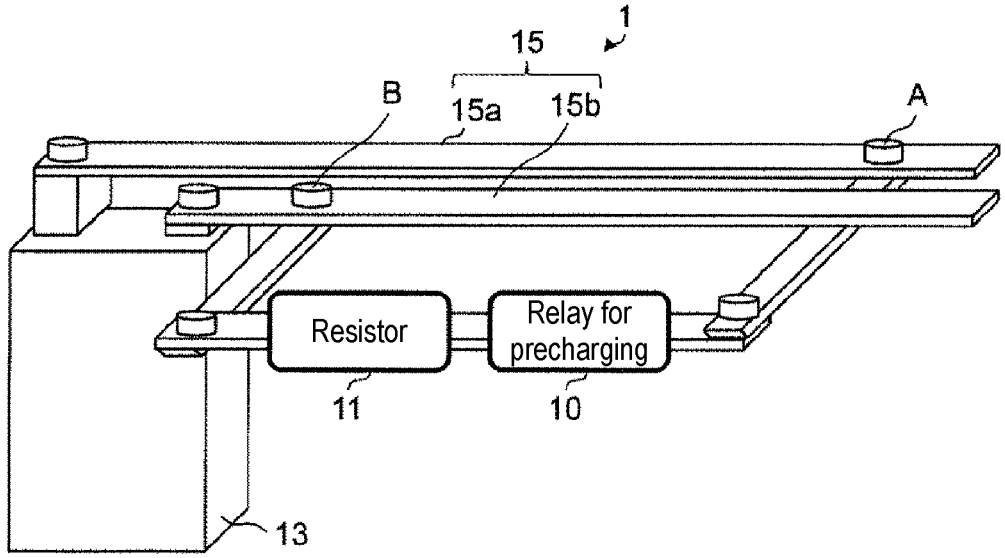
FIG. 2 is a circuit diagram schematically showing an example of the application case of the connection unit according to the first embodiment.

First, a description will be given of an example of a case where the present disclosure is applied with reference to FIG. 1 and FIG. 2. FIG. 1 and FIG. 2 are circuit diagrams schematically showing examples of application cases of a connection unit according to the embodiment. As shown in FIG. 1, a connection unit 1 according to the embodiment is connected in between a battery 3 and a motor 5 of an electric vehicle, for example.

The battery 3 and the motor 5 are connected to each other through the connection unit 1 and an inverter 7. The motor 5 and a generator 8 are connected to the inverter 7. The connection unit 1 opens and closes a current path for power supply, the current path extending from the battery 3 to the motor 5 through the inverter 7. Further, the connection unit 1 opens and closes a current path for charging, the current path extending from the generator 8 to the battery 3 through the inverter 7. Further, a capacitor 9 is provided in parallel with the inverter 7.

A relay 10 for precharging and a resistor 11 are connected in between the battery 3 and the inverter 7 in parallel with the connection unit 1. The relay 10 and the resistor 11 are provided to prevent an excessive inrush load from being applied to the connection unit 1 when the circuit is closed.

The connection unit 1 includes an electromagnetic relay 13 and a bus bar 15 connected to the electromagnetic relay 13. As shown in FIG. 2, the bus bar 15 includes a first bus bar 15*a* connected to a node A located adjacent to the battery 3, and a second bus bar 15*b* connected to a node B located adjacent to the inverter 7. Note that the first bus bar 15*a* may be connected to the node B, and the second bus bar 15*b* may be connected to the node A. A description will be given below of a structure of the connection unit 1.

First Embodiment

Figure 3:
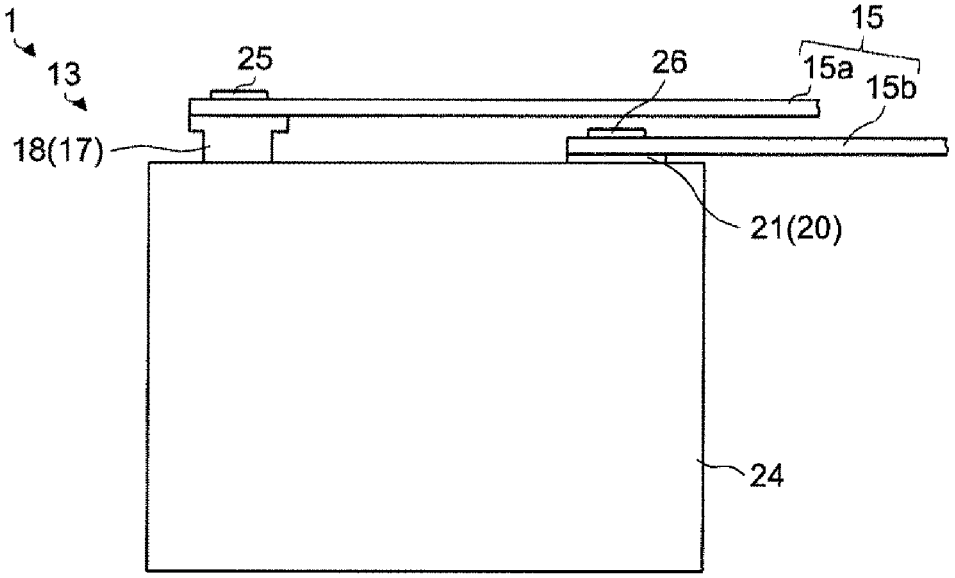
FIG. 3 is a front view schematically showing the connection unit according to the first embodiment.
Figure 4:
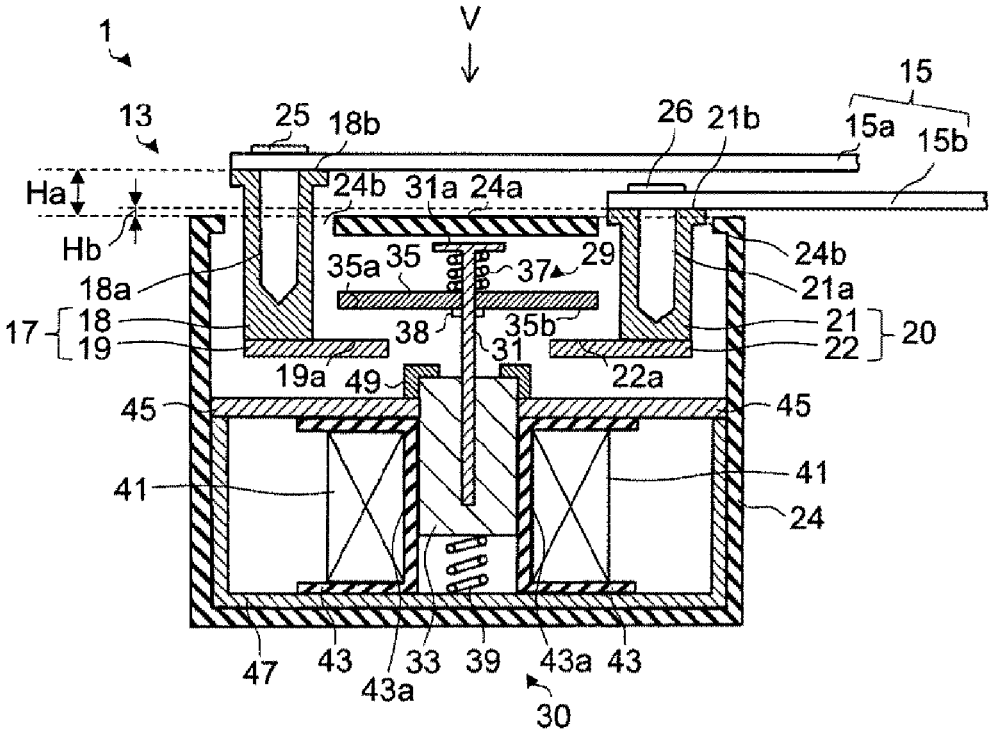
FIG. 4 is a front cross-sectional view schematically showing the connection unit in an open state.

A description will be given of the connection unit 1 according to a first embodiment of the present disclosure with reference to FIG. 3 and FIG. 4. FIG. 3 is a front view schematically showing the connection unit 1 according to the first embodiment. FIG. 4 is a front cross-sectional view schematically showing the connection unit 1 in an open state.

As shown in FIG. 3 and FIG. 4, the electromagnetic relay 13 includes a first fixed contact terminal 17 and a second fixed contact terminal 20 each connected to the bus bar 15, a movable touch piece 35, and a case 24 housing the first fixed contact terminal 17 and the second fixed contact terminal 20. The first fixed contact terminal 17 and the second fixed contact terminal 20 are fixed to the case 24 and are arranged apart from each other. The case 24 has, for example, a substantially square box shape and is made of an insulating resin.

As shown in FIG. 3, the bus bar 15 includes the first bus bar 15*a* connected to the first fixed contact terminal 17 and the second bus bar 15*b* connected to the second fixed contact terminal 20 outside the case 24. The first bus bar 15*a* and the second bus bar 15*b* are each made of a metal plate, for example.

As shown in FIG. 4, the first fixed contact terminal 17 and the second fixed contact terminal 20 are arranged side by side along a longitudinal axis of the first bus bar 15*a*. The movable touch piece 35 is disposed between the first fixed contact terminal 17 and the second fixed contact terminal 20 in the case 24 and is configured to move in a contact-making and breaking direction. The first fixed contact terminal 17 includes a support conductor 18 that has a substantially cylindrical shape and to which the first bus bar 15*a* is connected, and a first terminal portion 19 including a first fixed contact 19*a* that comes into and out of contact with a first movable contact 35*a* of the movable touch piece 35. Further, the second fixed contact terminal 20 includes a support conductor 21 that has a substantially cylindrical shape and to which the second bus bar 15*b* is connected, and a second terminal portion 22 including a second fixed contact 22*a* that comes into and out of contact with a second movable contact 35*b* of the movable touch piece 35.

The first terminal portion 19 and the second terminal portion 22 are made of metal and have a flat plate shape. The support conductor 18 and the first terminal portion 19, and the support conductor 21 and the second terminal portion 22 are connected, for example, by brazing. Alternatively, the support conductor 18 and the first terminal portion 19, and the support conductor 21 and the second terminal portion 22 may be connected by fit or connected with screws, rather than brazing. In the following description, a direction in which a first movable contact 35*a* and a second movable contact 35*b* of a movable touch piece 35 come out of contact with a first fixed contact 19*a* and a second fixed contact 22*a* is defined as an upward direction, and a direction in which the first movable contact 35*a* and the second movable contact 35*b* come into contact with the first fixed contact 19*a* and the second fixed contact 22*a* is defined as a downward direction. A contact-making and breaking direction is a direction in which the first movable contact 35*a* and the second movable contact 35*b* come into or out of contact with the first fixed contact 19*a* and the second fixed contact 22*a*.

The support conductors 18 and 21 have screw holes 18*a* and 21*a* that are blind holes extending from one end toward the other end. The first bus bar 15*a* is fixed to the support conductor 18 made of metal with a screw 25 screwed into the screw hole 18*a*. The second bus bar 15*b* is fixed to the support conductor 21 made of metal with a screw 26 screwed into the screw hole 21*a*. The support conductors 18 and 21 extend outward from the inside of the case 24, and protrude through openings 24*b* provided on an outer surface 24*a* serving as an upper surface of the case 24.

A height Ha from the outer surface 24*a* of the case 24 to a connection end surface 18*b* of the support conductor 18 that is in contact with the first bus bar 15*a* is greater than a height Hb from the outer surface 24*a* of the case 24 to a connection end surface 21*b* of the support conductor 21 that is in contact with the second bus bar 15*b*. As described above, the height Ha of the connection end surface 18*b* of the first fixed contact terminal 17 and the height Hb of the connection end surface 21*b* of the second fixed contact terminal 20 relative to the outer surface 24*a* of the case 24 are different from each other. Accordingly, with an insulation spacing provided between the two bus bars 15*a* and 15*b*, the first bus bar 15*a* can be disposed above the second bus bar 15*b*. This in turn makes it possible to prevent the first bus bar 15*a* and the second bus bar 15*b* from interfering with each other.

Further, the electromagnetic relay 13 further includes a contact mechanism unit 29 and an electromagnet unit 30 in the case 24.

The contact mechanism unit 29 includes a movable shaft 31 configured to move up and down along an axis of the movable shaft 31, a movable iron core 33 coupled to a lower portion of the movable shaft 31, the movable touch piece 35 through which the movable shaft 31 is inserted, a contact spring 37 that pushes the movable touch piece 35 downward in the contact-making and breaking direction, a stopper 38 that stops the movable touch piece 35 from moving downward, and a return spring 39 that pushes the movable iron core 33 upward in the contact-making and breaking direction.

The movable shaft 31 includes an upper portion passing through the movable touch piece 35 and a lower portion fixed to the movable iron core 33. The lower portion of the movable shaft 31 is inserted and supported in the electromagnet unit 30 together with the movable iron core 33, and the movable shaft 31 is configured to reciprocate along the axis of the movable shaft 31. The movable shaft 31 include a disk-shaped guard portion 31*a* at an upper end of the movable shaft 31. The contact spring 37 is provided between the disk-shaped guard portion 31*a* and the movable touch piece 35 and pushes the movable touch piece 35 toward the contact position in the contact-making and breaking direction.

The movable touch piece 35 is disposed in the case 24 and is configured to move in the contact-making and breaking direction. The movable touch piece 35 includes the first movable contact 35*a* and the second movable contact 35*b* on a surface facing the electromagnet unit 30 in the direction in which the axis of the movable shaft 31 extends (that is, the lower surface), the first movable contact 35*a* and the second movable contact 35*b* being configured to come into and out of contact with the first fixed contact 19*a* and the second fixed contact 22*a* in the contact-making and breaking direction. The first movable contact 35*a* faces the first fixed contact 19*a* of the first fixed contact terminal 17 and is configured to come into and out of contact with the first fixed contact 19*a*. Further, the second movable contact 35*b* faces the second fixed contact 22*a* of the second fixed contact terminal 20 and is configured to come into and out of contact with the second fixed contact 22*a*. The first bus bar 15*a* is disposed facing an upper surface of the movable touch piece 35 located on an opposite side of the movable touch piece 35 from the lower surface in the contact-making and breaking direction, with a gap provided between the first bus bar 15*a* and the movable touch piece 35 in the contact-making and breaking direction. Further, the outer surface 24*a* of the case 24 is located between the first bus bar 15*a* and the movable touch piece 35.

A lower end of the movable iron core 33 is supported by the return spring 39. When the electromagnet unit 30 has not been energized, the movable iron core 33 is pushed upward by a pushing force of the return spring 39, and when the electromagnet unit 30 has been energized, the movable iron core 33 is pulled downward against the pushing force of the return spring 39.

The electromagnet unit 30 includes a coil 41, a spool 43 having insulation properties, a first yoke 45, a second yoke 47 having a U shape, and a stopper 49. The coil 41 is wound around a body 43*a* of the spool 43. The first yoke 45 is fixed between upper ends serving as open ends of the second yoke 47. The stopper 49 is disposed on an upper portion of the first yoke 45 and restricts upward movement of the movable iron core 33.

Figure 5:
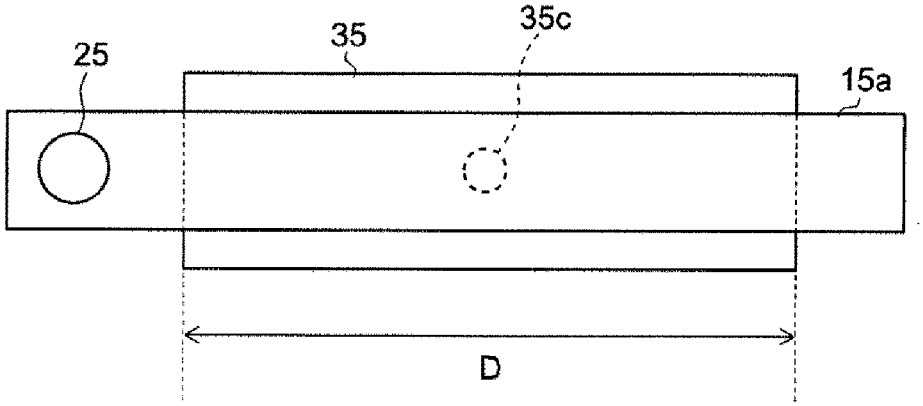
FIG. 5 is a plan view of FIG. 4 in a direction V.

Reference is now made to FIG. 5. FIG. 5 is a plan view of FIG. 4 in a direction V (that is, a top view in the contact-making and breaking direction). Note that, in FIG. 5, the case 24 and the contact mechanism unit 29 are not illustrated in order to facilitate understanding of a positional relation between the movable touch piece 35 and the first bus bar 15*a*.

The first bus bar 15*a* extends, in plan view in the contact-making and breaking direction, facing a center portion 35*c* of the movable touch piece 35 in a direction in which the first movable contact 35*a* and the second movable contact 35*b* are arranged. Further, the first bus bar 15*a* lies over, in plan view in the contact-making and breaking direction, a whole of the movable touch piece 35 in the direction in which the first movable contact 35*a* and the second movable contact 35*b* are arranged.

Next, a description will be given of an operation of the connection unit 1 having the above-described structure. First, as shown in FIG. 4, when no voltage is applied to the coil 41, the movable iron core 33 is pushed upward by a spring force of the return spring 39. This causes the movable shaft 31 integral with the movable iron core 33 to be pushed upward, and the movable touch piece 35 is pushed upward accordingly. This in turn brings about the open state where the first movable contact 35*a* and the second movable contact 35*b* of the movable touch piece 35 are out of contact with the first fixed contact 19*a* of the first terminal portion 19 and the second fixed contact 22*a* of the second terminal portion 22.

Figure 6:
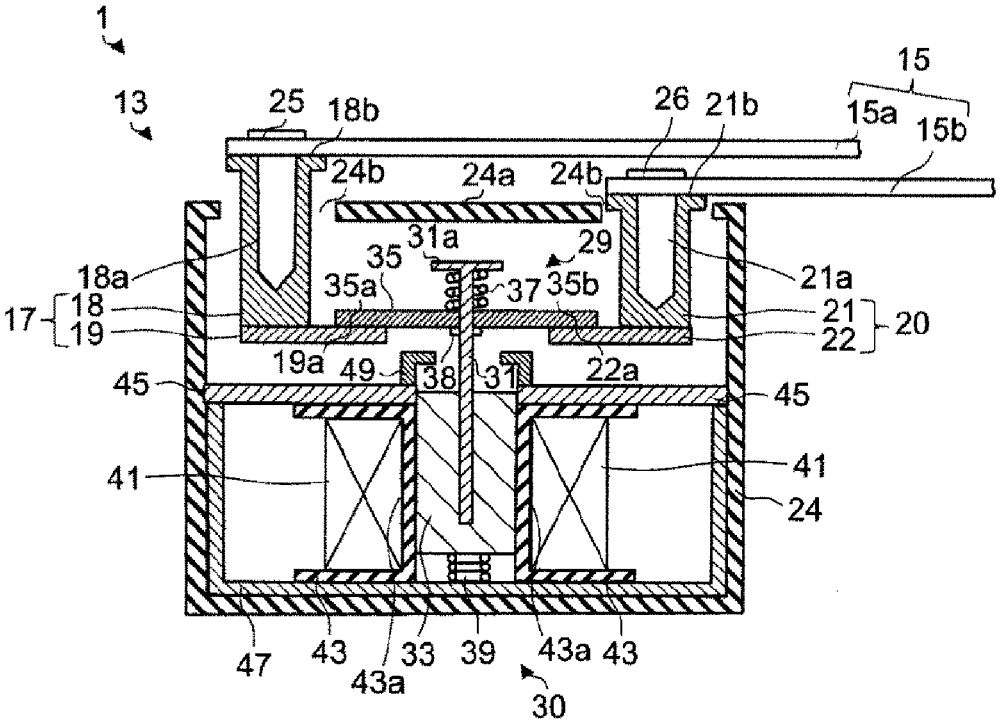
FIG. 6 is a front cross-sectional view schematically showing the connection unit in a closed state.
Figure 7:
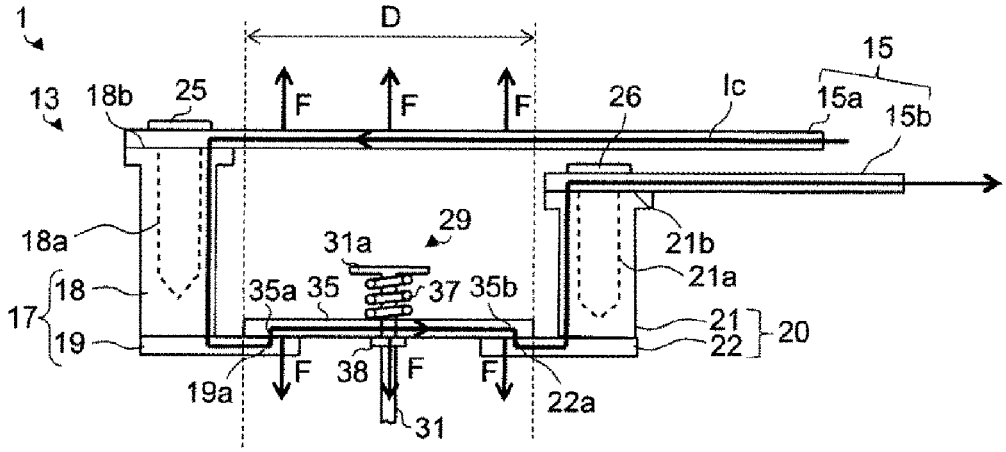
FIG. 7 is an explanatory diagram showing a direction of a current flowing through the connection unit in a closed state.

Next, when a voltage is applied to the coil 41 to energize the coil 41, the movable iron core 33 slides downward against the spring force of the return spring 39 as shown in FIG. 6. This brings about the closed state where the first movable contact 35*a* and the second movable contact 35*b* are in contact with the first fixed contact 19*a* and the second fixed contact 22*a*. In this closed state, as shown in FIG. 7, a current Ic flows from the first bus bar 15*a* connected to the battery 3 to the second bus bar 15*b* through the first fixed contact terminal 17, the movable touch piece 35, the second fixed contact terminal 20, the second bus bar 15*b*.

The first bus bar 15*a* is disposed facing the other surface (upper surface) located on the opposite side of the movable touch piece 35, in the contact-making and breaking direction, from the surface (lower surface) having the first movable contact 35*a* and the second movable contact 35*b*, with a gap provided between the first bus bar 15*a* and the movable touch piece 35. Further, the first bus bar 15*a* extends in a direction that intersects the contact-making and breaking direction and in which the first movable contact 35*a* and the second movable contact 35*b* of the movable touch piece 35 are connected. Therefore, for example, when the current Ic flows from the first bus bar 15*a* toward the second bus bar 15*b*, a section D is generated where, in respective regions of the first bus bar 15*a* and the movable touch piece 35 that lie over each other in plan view in the contact-making and breaking direction, a direction in which the current Ic flows through the first bus bar 15*a* extending above the movable touch piece 35 is opposite to a direction in which the current Ic flows through the movable touch piece 35. In this section D, the Lorentz force generates an electromagnetic repulsive force F that causes the first bus bar 15*a* and the movable touch piece 35 to repel each other in the contact-making and breaking direction. As a result, a force that is applied to the movable touch piece 35 to push the movable touch piece 35 against the first fixed contact 19*a* and the second fixed contact 22*a* along the axis of the movable shaft 31. Therefore, the electromagnetic repulsive force F pushes the first movable contact 35*a* and the second movable contact 35*b* against the first fixed contact 19*a* and the second fixed contact 22*a*, and it is thus possible to prevent the movable touch piece 35 from coming out of contact with the first fixed contact terminal 17 and the second fixed contact terminal 20. Further, unlike the conventional example, there is no need to arrange the first fixed contact terminal 17 and the second fixed contact terminal 20 directly above the movable touch piece 35 inside the electromagnetic relay 13, preventing an increase in size of the electromagnetic relay 13.

Note that at least part of the first bus bar 15*a* may lie over the movable touch piece 35 in plan view in the contact-making and breaking direction, and the electromagnetic repulsive force F is generated in each of the regions lying over each other. The larger the regions where the first bus bar 15*a* and the movable touch piece 35 lie over each other in plan view in the contact-making and breaking direction is, the larger the Lorentz force becomes. Further, since the Lorentz force is proportional to the square of a value of the current, the larger the value of the current flowing through the movable touch piece 35 is, the larger the contact pressure applied from the first movable contact 35*a* and the second movable contact 35*b* to the first fixed contact 19*a* and the second fixed contact 22*a* becomes. This in turn makes it possible to prevent the contacts from coming out of contact with each other.

Further, the first bus bar 15*a* extends, in plan view in the contact-making and breaking direction, facing the center portion 35*c* of the movable touch piece 35 in a direction in which the two movable contacts 35*a* and 35*b*, the first movable contact 35*a* and the second movable contact 35*b*, are connected. This makes it possible to push, when the current Ic flows in the closed state, the center portion 35*c* of the movable touch piece 35 downward, which in turn makes it possible for the first movable contact 35*a* and the second movable contact 35*b* located at both ends of the movable touch piece 35 to evenly come into contact with the two fixed contacts of the first fixed contact terminal 17 and the second fixed contact terminal 20.

Further, the first bus bar 15*a* lies over, in plan view in the contact-making and breaking direction, a whole of the movable touch piece 35 in the direction in which the two movable contacts, the first movable contact 35*a* and the second movable contact 35*b*, are connected. This applies a downward force to the whole of the movable touch piece 35, making it possible to prevent the movable touch piece 35 from coming out of contact with the first fixed contact 19*a* of the first fixed contact terminal 17 and the second fixed contact 22*a* of the second fixed contact terminal 20.

Further, since the connection end surface 18*b* of the support conductor 18 connected to the first bus bar 15*a* and the connection end surface 21*b* of the support conductor 21 connected to the second bus bar 15*b* are different from each other in height relative to the outer surface 24*a*, the first bus bar 15*a* can extend facing the movable touch piece 35, and in some case, the first bus bar 15*a* can also extend facing the second bus bar 15*b*. This increases a degree of freedom in layout design of the first bus bar 15*a* and the second bus bar 15*b*.

Second Embodiment

Figure 8:
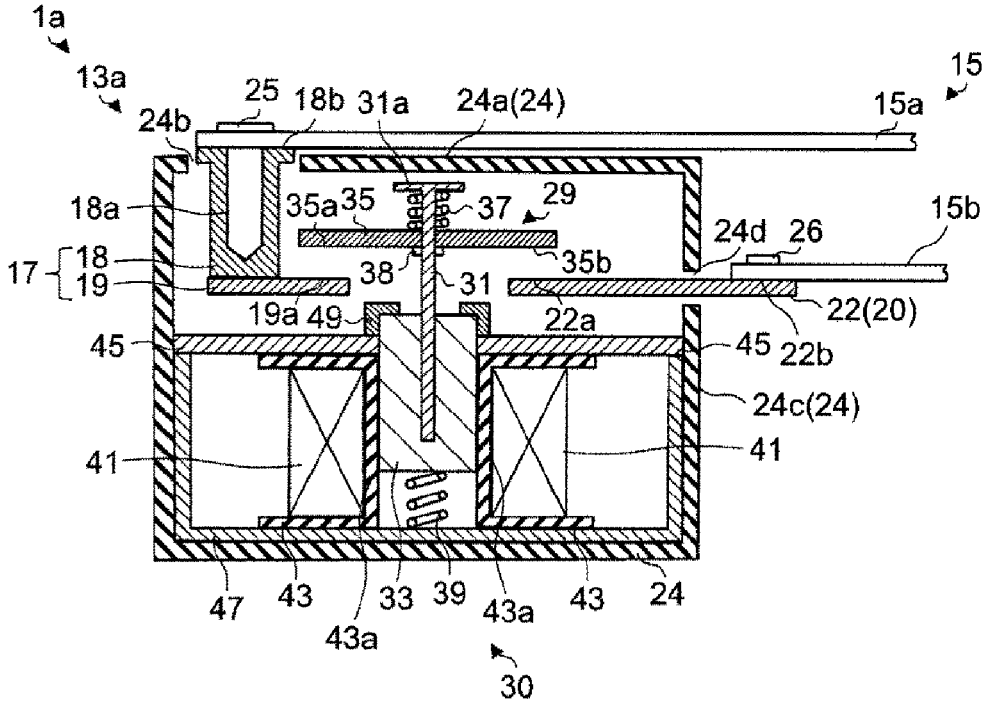
FIG. 8 is a front cross-sectional view schematically showing a connection unit in an open state according to a second embodiment.

Next, a description will be given of a connection unit 1*a* according to a second embodiment of the present disclosure with reference to FIG. 8. FIG. 8 is a front cross-sectional view of the connection unit 1*a* according to the second embodiment. The first fixed contact terminal 17 and the second fixed contact terminal 20 of the electromagnetic relay 13 of the first embodiment protrude from the same outer surface 24*a* of the case 24, whereas the second fixed contact terminal 20 of an electromagnetic relay 13*a* of the second embodiment protrude from an outer surface 24*c* of the case 24 different from the outer surface 24*a* from which the first fixed contact terminal 17 protrudes. Note that the connection unit 1*a* according to the second embodiment is identical to the connection unit 1 according to the first embodiment in structure other than features to be described below.

The second fixed contact terminal 20 according to the second embodiment does not include the support conductor 21 according to the first embodiment. According to the second embodiment, the second terminal portion 22 having a flat plate shape extends outward from the inside of the case 24. A connection end surface 22*b* of the second terminal portion 22 protrudes outward of the case 24 through an opening 24*d* provided on the outer surface 24*c* of the case 24 that is different from and intersects with the outer surface 24*a*. The second terminal portion 22 is connected to the second bus bar 15*b* with the screw 26 at the connection end surface 22*b*. Further, the connection end surface 18*b* of the first fixed contact terminal 17 protrudes from one outer surface 24*a* of the case 24 and is connected to the first bus bar 15*a*.

Figure 9:
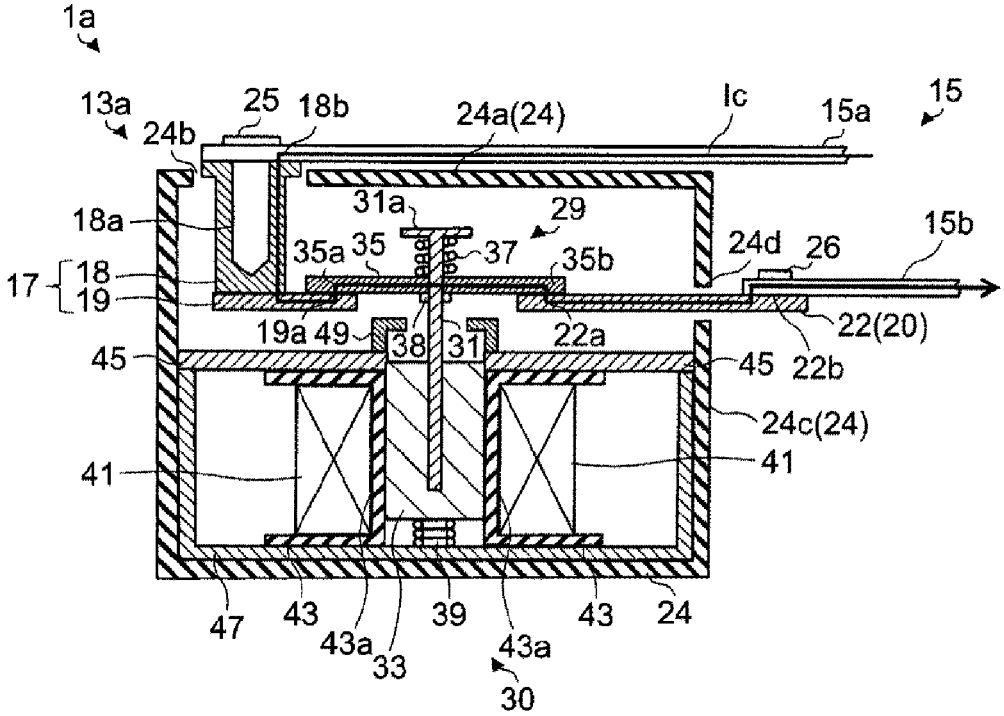
FIG. 9 is a front cross-sectional view schematically showing the connection unit in a closed state.

Reference is made to FIG. 9. FIG. 9 is a front cross-sectional view of the connection unit in a closed state according to the second embodiment. The second fixed contact terminal 20 extends from a side surface of the case 24 in a direction intersecting the contact-making and breaking direction, and it is thus possible to connect the second fixed contact terminal 20 to the bus bar 15*b* in a direction intersecting the contact-making and breaking direction relative to the case 24. This allows the first bus bar 15*a* to be disposed in proximity to a surface (upper surface) of the case 24 in the contact-making and breaking direction, and it is thus possible to reduce a distance between the first bus bar 15*a* and the movable touch piece 35. This in turn makes it possible to increase the electromagnetic repulsive force F that is generated by the Lorentz force and is applied to the movable touch piece 35.

Third Embodiment

Figure 10:
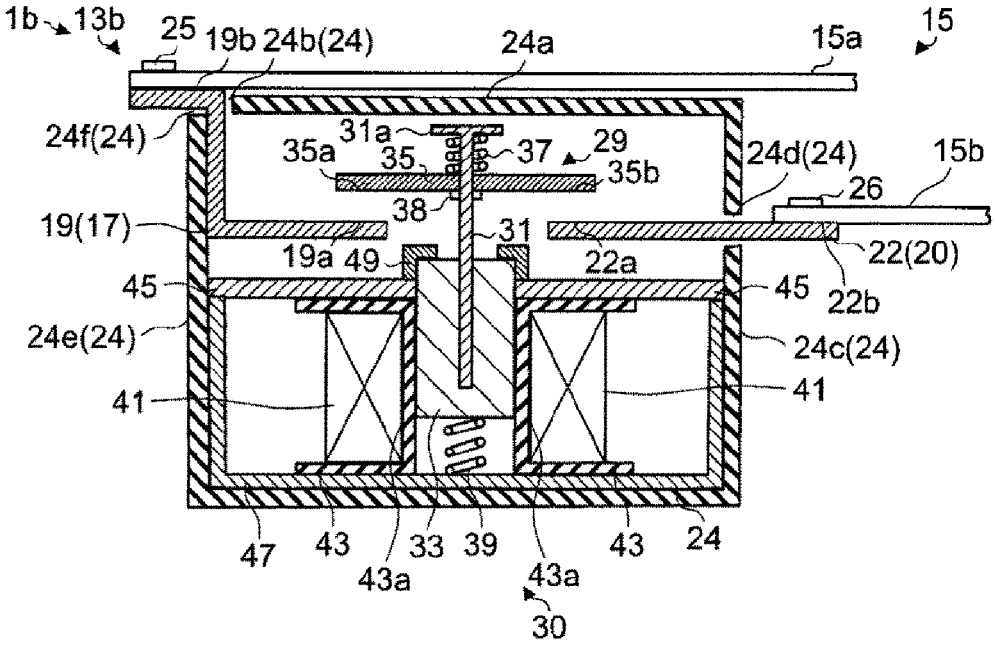
FIG. 10 is a front cross-sectional view schematically showing a connection unit in an open state according to a third embodiment.
Figure 11:
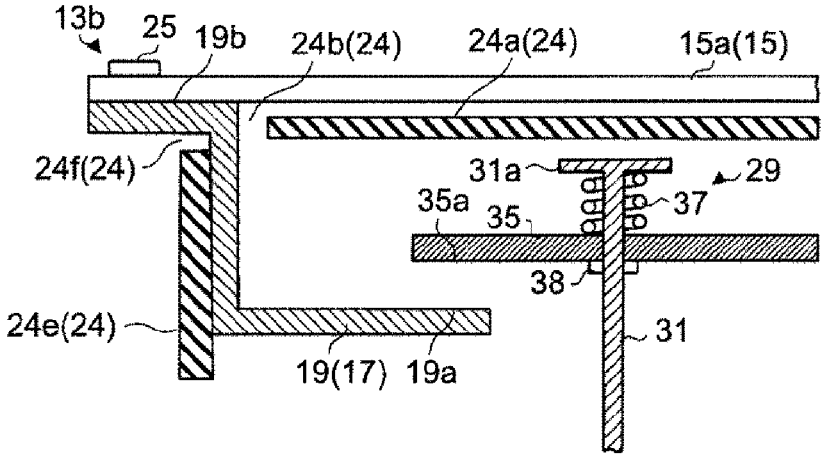
FIG. 11 is a partially enlarged view of FIG. 10.
Figure 12:
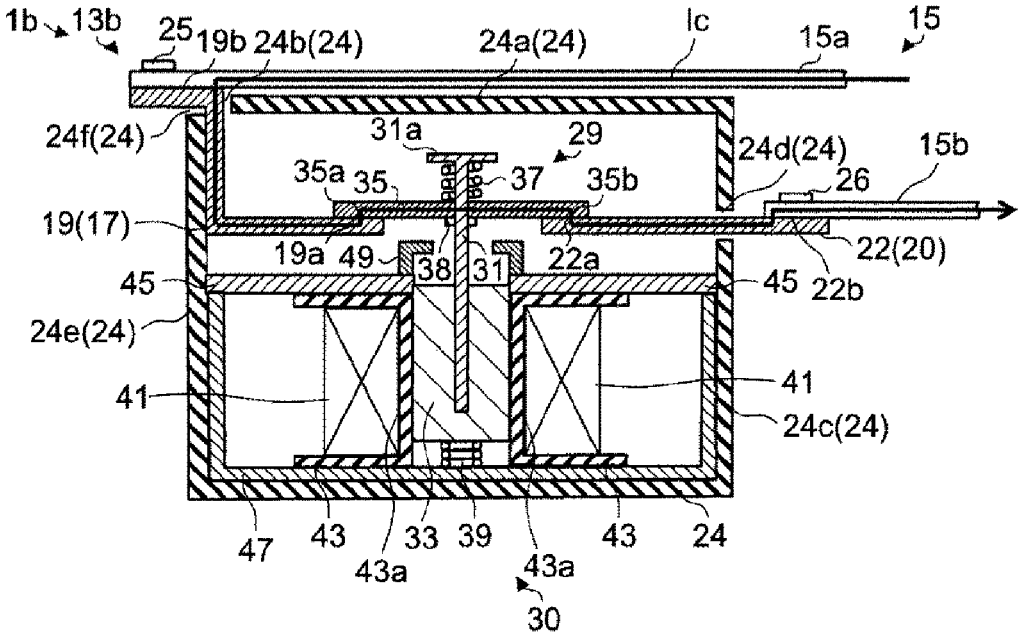
FIG. 12 is a front cross-sectional view schematically showing the connection unit in a closed state.

Next, a description will be given of a connection unit 1*b* according to a third embodiment of the present disclosure with reference to FIG. 10 to FIG. 12. FIG. 10 is a front cross-sectional view schematically showing a connection unit 1*b* in an open state according to the third embodiment. FIG. 11 is a partially enlarged view of FIG. 10. FIG. 12 is a front cross-sectional view schematically showing the connection unit 1*b* in a closed state. The support conductor 18 of the first fixed contact terminal 17 according to the second embodiment protrudes from the outer surface 24*a* serving as the upper surface of the case 24, whereas the first fixed contact terminal 17 according to the third embodiment protrudes from an outer surface 24*e* of the case 24 that faces the outer surface 24*c* of the case 24 from which the second fixed contact terminal 20 protrudes. Note that the connection unit 1*b* according to the third embodiment is identical to the connection unit 1*a* according to the second embodiment in structure other than features to be described below.

The first fixed contact terminal 17 of an electromagnetic relay 13*b* according to the third embodiment does not include the support conductor 18 according to the second embodiment. As shown in FIG. 11, according to the third embodiment, the first terminal portion 19 having a flat plate shape extends outward from the inside of the case 24 in parallel with the movable touch piece 35, bends at a contact position with the case 24, and then extends upward along an inner surface of the case 24 in parallel with the movable shaft 31. The first terminal portion 19 further bends outward at an opening including the opening 24*b* provided on the outer surface 24*a* serving as the upper surface of the case 24, and an opening 24*f* provided at an upper end of the outer surface 24*e* that faces the outer surface 24*c*, and then extends in parallel with the movable touch piece 35. A connection end surface 19*b* of the first fixed contact terminal 17 protrudes outward of the case 24 through the opening 24*f* provided on the outer surface 24*e* of the case 24 that is different from and intersects with the outer surface 24*a*.

According to the third embodiment, as shown in FIG. 10, the first bus bar 15*a* is disposed facing the outer surface 24*a* of the case 24. Further, the first fixed contact terminal 17 and the second fixed contact terminal 20 are disposed protruding outward of the case 24 from the outer surface 24*c* and the outer surface 24*e* of the case 24 that intersect with the outer surface 24*a* and face each other, and the first fixed contact terminal 17 and the second fixed contact terminal 20 are connected to the first bus bar 15*a* and the second bus bar 15*b*.

The second fixed contact terminal 20 extends from a side surface of the case 24 in a direction intersecting the contact-making and breaking direction, and it is thus possible to connect the second fixed contact terminal 20 to the bus bar 15*b* in a direction intersecting the contact-making and breaking direction relative to the case 24. This allows the first bus bar 15*a* to be disposed in proximity to the outer surface 24*a* (that is, the upper surface) of the case 24 in the contact-making and breaking direction. Further, the first fixed contact terminal 17 extends outward from the outer surface 24*e* in the direction intersecting the contact-making and breaking direction, and it is thus possible for the connection end surface 19*b* that is in contact with the first bus bar 15*a* to be disposed in proximity to the outer surface 24*a* in the contact-making and breaking direction. This makes it possible to reduce the distance between the first bus bar 15*a* and the movable touch piece 35, which in turn makes it possible to increase the electromagnetic repulsive force F that is generated by the Lorentz force and is applied to the movable touch piece 35.

Figure 13:
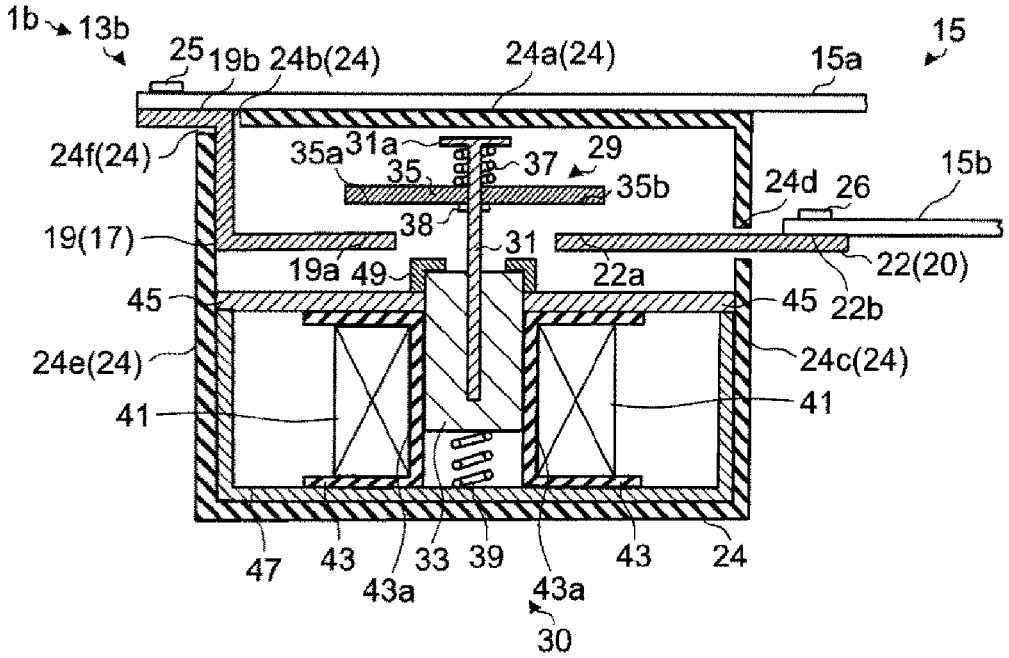
FIG. 13 is a front cross-sectional view schematically showing a connection unit in an open state according to a modification of the third embodiment.

As shown in FIG. 13, the connection end surface 19*b* that is in contact with the first bus bar 15*a* may be flush with the outer surface 24*a*. This allows the first bus bar 15*a* to be disposed along the outer surface 24*a*, and it is thus possible to further reduce the distance between the first bus bar 15*a* and the movable touch piece 35. This in turn makes it possible to increase the electromagnetic repulsive force F that is generated by the Lorentz force and is applied to the movable touch piece 35. As described above, when the connection end surface 19*b* that is in contact with the first bus bar 15*a* protrudes slightly upward relative to the outer surface 24*a* or is flush with the outer surface 24*a*, the first bus bar 15*a* is easily connected to the connection end surface 19*b*.

Fourth Embodiment

Figure 14:
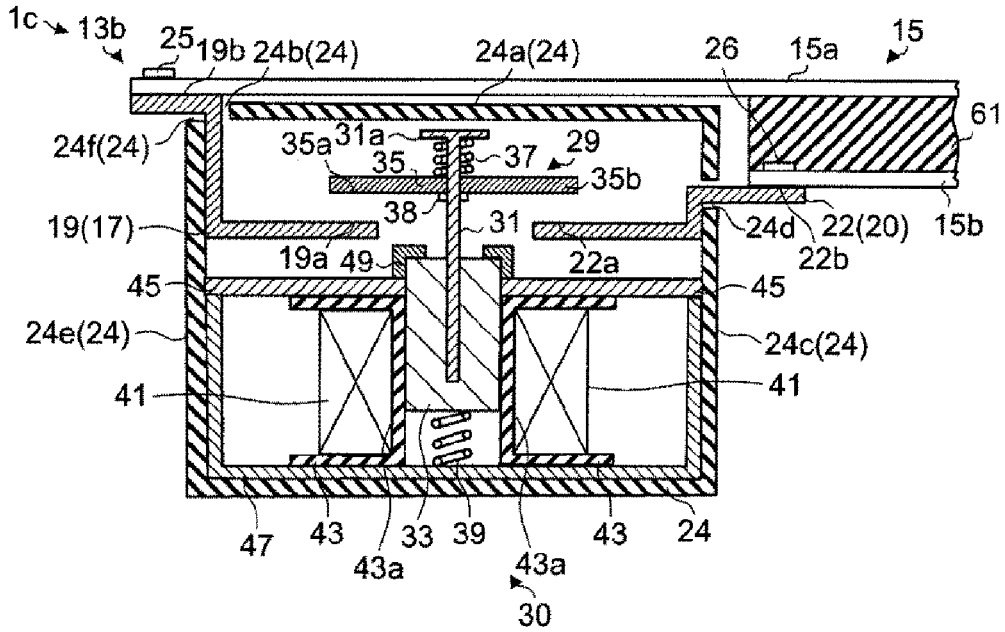
FIG. 14 is a front cross-sectional view schematically showing a connection unit in an open state according to a fourth embodiment.

Next, a description will be given of a connection unit 1*c* according to a fourth embodiment of the present disclosure with reference to FIG. 14. FIG. 14 is a front cross-sectional view schematically showing the connection unit 1*c* in an open state according to the fourth embodiment. The first bus bar 15*a* and the second bus bar 15*b* of the connection unit 1*b* according to the third embodiment are air-insulated from each other, whereas, according to the fourth embodiment, an insulating member 61 is disposed between the first bus bar 15*a* and the second bus bar 15*b* of the connection unit 1*c*. Note that the connection unit 1*c* according to the fourth embodiment is identical to the connection unit 1*b* according to the third embodiment in structure other than features to be described below.

The insulating member 61 may be made of a synthetic resin such as polyester or epoxy resin, or may be made of an inorganic material such as mica or glass fiber. The insulating member 61 is disposed between the first bus bar 15*a* and the second bus bar 15*b* outside the case 24, and it is thus possible to prevent a short circuit between the first bus bar 15*a* and the second bus bar 15*b*.

Fifth Embodiment

Figure 15:
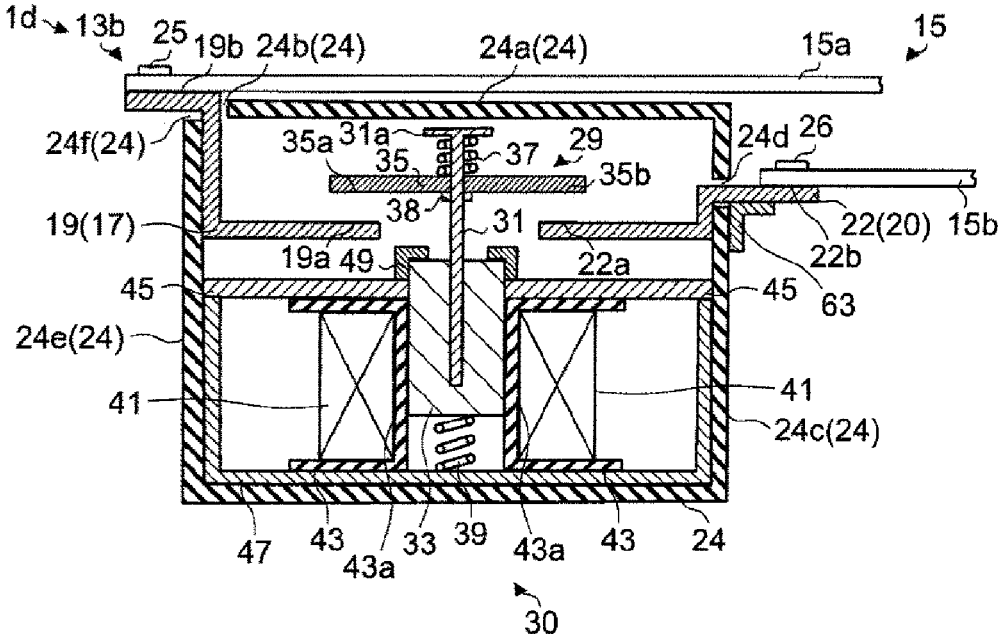
FIG. 15 is a front cross-sectional view schematically showing a connection unit in an open state according to a fifth embodiment.

Next, a description will be given of a connection unit 1*d* according to a fifth embodiment of the present disclosure with reference to FIG. 15. FIG. 15 is a front cross-sectional view schematically showing the connection unit 1*d* in an open state according to the fifth embodiment. The second bus bar 15*b* of the connection unit 1*b* according to the third embodiment is supported by the case 24 of the electromagnetic relay 13*b*, whereas, according to the fifth embodiment, a reinforcing plate 63 is additionally attached to the second bus bar 15*b* of the connection unit 1*d*. Note that the connection unit 1*d* according to the fifth embodiment is identical to the connection unit 1*b* according to the third embodiment in structure other than features to be described below.

The reinforcing plate 63 connects the second fixed contact terminal 20 located outside the case 24 to the outer surface 24*c* of the case 24. The reinforcing plate 63 may be made of metal or an insulating member. This makes it possible to prevent the second bus bar 15*b* from being warped even when the electromagnetic repulsive force is generated by the Lorentz force between the first bus bar 15*a* and the second bus bar 15*b* arranged in parallel with each other.

Sixth Embodiment

Figure 16:
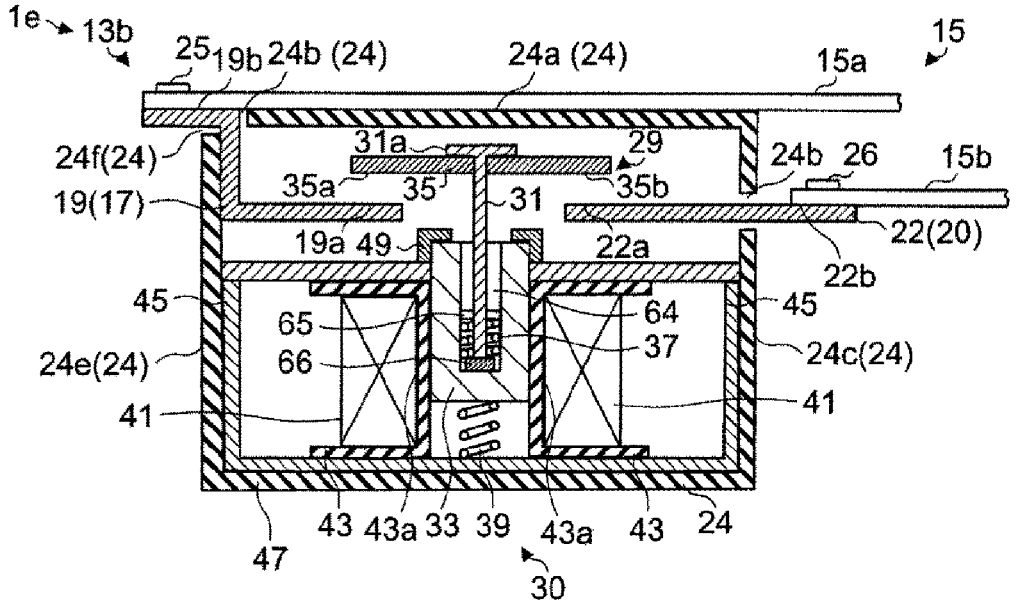
FIG. 16 is a front cross-sectional view schematically showing a connection unit in an open state according to a sixth embodiment.

Next, a description will be given of a connection unit 1*e* according to a sixth embodiment of the present disclosure with reference to FIG. 16. FIG. 16 is a front cross-sectional view schematically showing the connection unit 1*e* in an open state according to the sixth embodiment. In the connection unit 1*b* according to the third embodiment, the contact spring 37 that pushes the movable touch piece 35 downward is provided on a side of the movable touch piece 35 remote from the movable iron core 33. On the other hand, in the connection unit 1*e* according to the sixth embodiment, the contact spring 37 is provided in the movable iron core 33 rather than the movable touch piece 35. Note that the connection unit 1*e* according to the sixth embodiment is identical to the connection unit 1*b* according to the third embodiment in structure other than features to be described below.

The movable iron core 33 according to the sixth embodiment includes a hollow hole 64 that results from hollowing out a portion of the movable iron core 33 where the movable shaft 31 is inserted. The contact spring 37 is inserted in the hollow hole 64. On a side of the contact spring 37 adjacent to the movable touch piece 35, a ring 65 is disposed in the hollow hole 64. The contact spring 37 is disposed between the ring 65 and a ring 66 in a state where the contact spring 37 keeps pushing the movable shaft 31 toward the contact position in a contact-opening and breaking direction.

The ring 65 is fixed to the movable iron core 33 and has a through hole, and the movable shaft 31 slides through the through hole. The ring 66 is fixed to the lower end of the movable shaft 31. The ring 66 is held between a lower end of the contact spring 37 and a bottom surface of the hollow hole 64 of the movable iron core 33.

When a voltage is applied to the coil 41 to energize the coil 41, the contact mechanism unit 29 slides downward against the spring force of the return spring 39. This brings about the closed state where the first movable contact 35*a* and the second movable contact 35*b* are in contact with the first fixed contact 19*a* and the second fixed contact 22*a*, respectively. After being brought into the closed state, the movable iron core 33 and the ring 65 further move downward to compress the contact spring 37 to maintain contact pressure between the first movable contact 35*a* and the first fixed contact 19*a* and contact pressure between the second movable contact 35*b* and the second fixed contact 22*a*.

Since the contact spring 37 is not disposed between the disk-shaped guard portion 31*a* of the movable shaft 31 and the movable touch piece 35, it is possible to further reduce the distance between the first bus bar 15*a* and the movable touch piece 35, which in turn makes it possible to increase the electromagnetic repulsive force F that is generated by the Lorentz force and is applied to the movable touch piece 35.

The present disclosure is not limited to the above embodiments and can be modified as follows.

According to the first embodiment, the height of the connection end surface 18*b* of the support conductor 18 relative to the outer surface 24*a* of the case 24 is greater than the height of the connection end surface 21*b* of the support conductor 21, but the present disclosure is not limited to this structure. The height of the connection end surface 18*b* and the height of the connection end surface 21*b* may be the same. In this structure, at least one of the first bus bar 15*a* and the second bus bar 15*b* has an L shape or a U shape, so that interference between the first bus bar 15*a* and the second bus bar 15*b* can be prevented.

Further, the height of the connection end surface 21*b* of the support conductor 21 relative to the outer surface 24*a* of the case 24 may be greater than the height of the connection end surface 18*b* of the support conductor 18. In this structure, the first bus bar 15*a* has an L shape or a U shape, so that interference between the first bus bar 15*a* and the support conductor 21 of the second fixed contact terminal 20 can be prevented.

Figure 17:
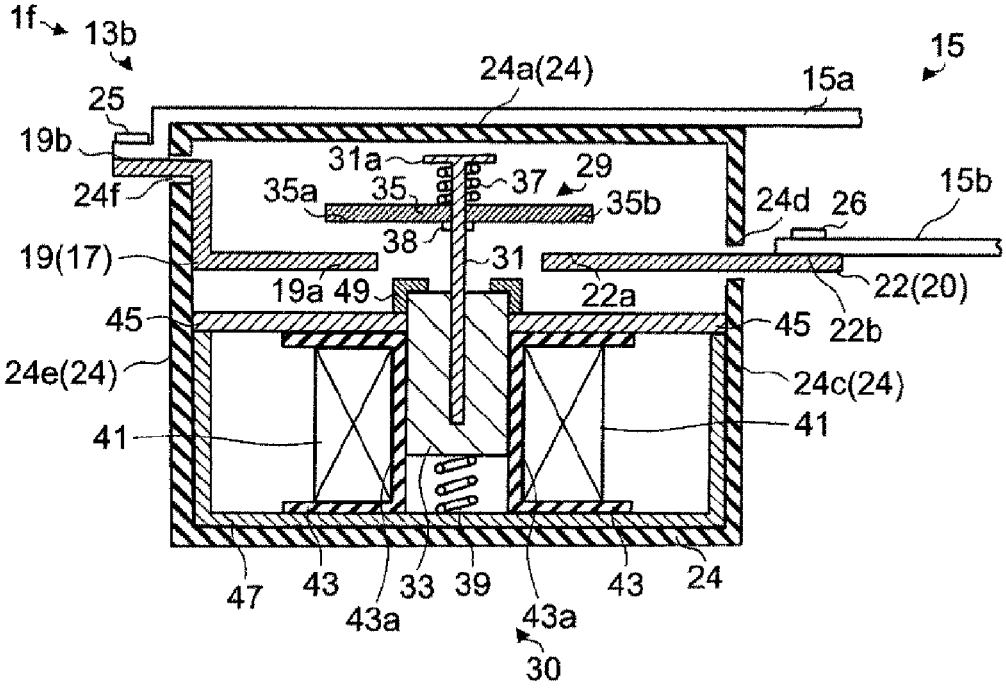
FIG. 17 is a front cross-sectional view schematically showing a connection unit in an open state according to a modification.
Figure 18:
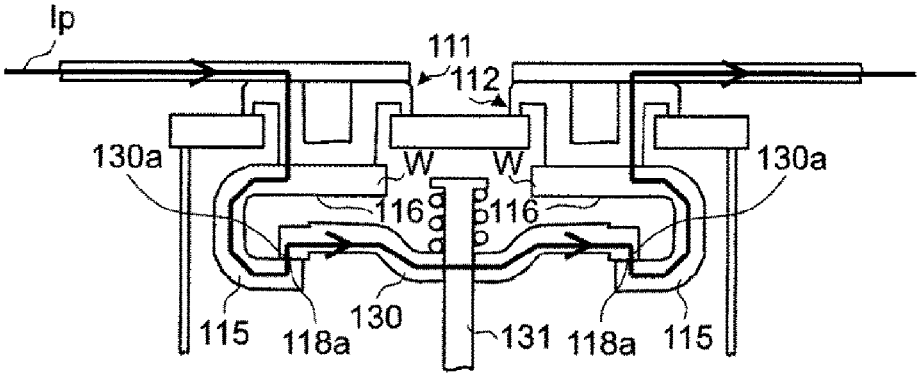
FIG. 18 is a partial front cross-sectional view of a connection unit according to a conventional example.

According to the third embodiment, the first terminal portion 19 extends outward through the opening including the opening 24*b* provided on the outer surface 24*a* serving as the upper surface of the case 24 and the opening 24*f* provided at the upper end of the outer surface 24*e* that faces the outer surface 24*c*, but the present disclosure is not limited to this structure. Like the connection unit 1*f* shown in FIG. 17, the connection end surface 19*b* of the first terminal portion 19 does not extend through the opening 24*b* and may protrude outward of the case 24 through the opening 24*f* provided on the outer surface 24*e* of the case 24 that is different from and intersects with the outer surface 24*a*. Even in this structure, the first bus bar 15*a* can be disposed on the outer surface 24*a* of the case 24, and it is thus possible to reduce the distance between the first bus bar 15*a* and the movable touch piece 35, which in turn makes it possible to increase the electromagnetic repulsive force that is generated by the Lorentz force and is applied to the movable touch piece 35.

The detailed description has been given of various embodiments according to the present disclosure with reference to the drawings, and, in conclusion, a description will be given of various aspects of the present disclosure. Note that, in the following description, reference numerals are also given as an example.

The connection unit 1, la to 1*f* of a first aspect of the present disclosure includes the electromagnetic relay 13, 13*a*, 13*b*, and the bus bar 15 connected to the electromagnetic relay 13, 13*a*, 13*b*. In the connection unit 1, 1*a* to 1*f*, the electromagnetic relay 13, 13*a*, 13*b* includes the case 24, the first fixed contact terminal 17 fixed to the case 24, the first fixed contact terminal 17 extending outward from the inside of the case 24 and including the first fixed contact 19*a*, the second fixed contact terminal 20 fixed to the case 24, the second fixed contact terminal 20 extending outward from the inside of the case 24 and including the second fixed contact 22*a*, and the movable touch piece 35 including, on one surface of the movable touch piece 35, the first movable contact 35*a* and the second movable contact 35*b* configured to come into and out of contact with the first fixed contact 19*a* of the first fixed contact terminal 17 and the second fixed contact 22*a* of the second fixed contact terminal 20 in the contact-making and breaking direction that is a direction in which the first movable contact 35*a* and the second movable contact 35*b* come into or out of contact with the first fixed contact 19*a* and the second fixed contact 22*a*, the movable touch piece 35 being disposed in the case 24 and configured to move in the contact-making and breaking direction. The bus bar 15 includes, outside the case 24, the first bus bar 15*a* connected to the first fixed contact terminal 17, and the second bus bar 15*b* connected to the second fixed contact terminal 20, the first bus bar 15*a* is disposed facing the other surface of the movable touch piece 35 located on the opposite side of the movable touch piece 35 from the one surface in the contact-making and breaking direction, with a gap provided between the first bus bar 15*a* and the movable touch piece 35 in the contact-making and breaking direction, the first bus bar 15*a* extends in a direction that intersects the contact-making and breaking direction and in which the first movable contact 35*a* and the second movable contact 35*b* of the movable touch piece 35 are arranged, and at least part of the first bus bar 15 lies over the movable touch piece 35 in plan view in the contact-making and breaking direction.

According to the connection unit 1, la to 1*f* of the first aspect, in respective regions of the first bus bar 15*a* and the movable touch piece 35 that lie over each other in plan view in the contact-making and breaking direction, a direction in which a current flows through the first bus bar 15*a* extending in the direction that intersects the contact-making and breaking direction and in which the first movable contact 35*a* and the second movable contact 35*b* of the movable touch piece 35 are arranged is opposite to a direction in which a current flows through the movable touch piece 35. As a result, a force that is applied to the movable touch piece 35 to push the movable contacts toward the fixed contacts is generated by the Lorentz force, and it is thus possible to increase contact pressure between the movable contact 35*a* of the movable touch piece 35 and the first fixed contact 19*a*, and contact pressure between the movable contact 35*b* of the movable touch piece 35 and the second fixed contact 22*a*. Therefore, an electromagnetic repulsive force derived from the Lorentz force can prevent the movable touch piece 35 from coming out of contact with the first fixed contact terminal 17 and the second fixed contact terminal 20.

In the connection unit 1, 1*a* to 1*f* of a second aspect of the present disclosure, the first bus bar 15*a* extends facing, in the plan view, the center portion 35*c* of the movable touch piece 35 in the direction in which the first movable contact 35*a* and the second movable contact 35*b* are arranged.

According to the connection unit 1, 1*a* to 1*f* of the second aspect, it is possible to push, when the current Ic flows in a closed state, the center portion 35*c* of the movable touch piece 35 downward, which in turn makes it possible for the first movable contact 35*a* and the second movable contact 35*b* located at both ends of the movable touch piece 35 to evenly come into contact with the two fixed contacts of the first fixed contact terminal 17 and the second fixed contact terminal 20.

In the connection unit 1, 1*a* to 1*f* of a third aspect of the present disclosure, the first bus bar 15*a* lies over, in the plan view, a whole of the movable touch piece 35 in the direction in which the first movable contact 35*a* and the second movable contact 35*b* are arranged.

According to the connection unit 1, 1*a*-1*f* of the third aspect, a downward force applied to the whole of the movable touch piece 35 is generated, and it is thus possible to prevent the movable touch piece 35 from coming out of contact with the first fixed contact 19*a* of the first fixed contact terminal 17 and the second fixed contact 22*a* of the second fixed contact terminal 20.

In the connection unit 1 of a fourth aspect of the present disclosure, the connection end surface 18*b* of the first fixed contact terminal 17 connected to the first bus bar 15*a* and the connection end surface 21*b* of the second fixed contact terminal 20 connected to the second bus bar 15*b* protrude outward relative to the first outer surface 24*a* of the case 24, and the connection end surface 18*b* of the first fixed contact terminal 17 and the connection end surface 21*b* of the second fixed contact terminal 20 relative to the first outer surface 24*a* of the case 24 are different in height from each other.

According to the connection unit 1 of the fourth aspect, with an insulation spacing provided between the first bus bar 15*a* and the second bus bar 15*b*, the first bus bar 15*a* can be disposed above the second bus bar 15*b*, for example. This in turn makes it possible to prevent the first bus bar 15*a* and the second bus bar 15*b* from interfering with each other.

In the connection unit 1*a* of a fifth aspect of the present disclosure, the connection end surface 18*b* of the first fixed contact terminal 17 protrudes from the first outer surface 24*a* of the case 24 and is connected to the first bus bar 15*a*, and the connection end surface 21*b* of the second fixed contact terminal 20 protrudes outward of the case 24 from the second outer surface 24*c* of the case 24 intersecting with the first outer surface 24*a* and is connected to the second bus bar 15*b*.

According to the connection unit 1*a* of the fifth aspect, the second fixed contact terminal 20 extends from the second outer surface 24*c* of the case 24 in a direction intersecting the contact-making and breaking direction, and it is thus possible to connect the second fixed contact terminal 20 to the bus bar 15*b* in the direction intersecting the contact-making and breaking direction relative to the case 24. This allows the first bus bar 15*a* to be disposed in proximity to a surface of the case 24 in the contact-making and breaking direction, and it is thus possible to reduce the distance between the first bus bar 15*a* and the movable touch piece 35. This in turn makes it possible to increase the electromagnetic repulsive force F that is generated by the Lorentz force and is applied to the movable touch piece 35.

In the connection unit 1*b*, 1*e* of a sixth aspect of the present disclosure, the first bus bar 15*a* is disposed along the first outer surface 24*a* of the case 24.

According to the connection unit 1*b*, 1*e* of the sixth aspect, the first bus bar 15*a* is disposed along the first outer surface 24*a*, and it is thus possible to further reduce the distance between the first bus bar 15*a* and the movable touch piece 35. This in turn makes it possible to increase the electromagnetic repulsive force F that is generated by the Lorentz force and is applied to the movable touch piece 35.

In the connection unit 1*b* to 1*f* of a seventh aspect of the present disclosure, the first bus bar 15*a* is disposed on the first outer surface 24*a* of the case 24, the first fixed contact terminal 17 and the second fixed contact terminal 20 are disposed protruding outward of the case 24 from the second outer surface 24*c* and the third outer surface 24*e* of the case 24 that intersect with the first outer surface 24*a* and face each other, and the first fixed contact terminal 17 and the second fixed contact terminal 20 are connected to the first bus bar 15*a* and the second bus bar 15*b*.

According to the connection unit 1*b* to 1*f* of the seventh aspect, the second fixed contact terminal 20 extends from the second outer surface 24*c* of the case 24 in a direction intersecting the contact-making and breaking direction, and it is thus possible to connect the second fixed contact terminal 20 to the bus bar 15*b* in the direction intersecting the contact-making and breaking direction relative to the case 24. This allows the first bus bar 15*a* to be disposed in proximity to the first outer surface 24*a* of the case 24 in the contact-making and breaking direction. Further, the first fixed contact terminal 17 extends outward from the third outer surface 24*e* in a direction intersecting the contact-making and breaking direction, and it is thus possible for the connection end surface 19*b* that is in contact with the first bus bar 15*a* to be disposed in proximity to the outer surface 24*a* in the contact-making and breaking direction. This makes it possible to reduce the distance between the first bus bar 15*a* and the movable touch piece 35, which in turn makes it possible to increase the electromagnetic repulsive force F that is generated by the Lorentz force and is applied to the movable touch piece 35.

In the connection unit 1*c* of an eighth aspect of the present disclosure, outside the case 24, the insulating member 61 is disposed between the first bus bar 15*a* and the second bus bar 15*b*.

According to the connection unit 1*c* of the eighth aspect, the insulating member 61 is disposed between the first bus bar 15*a* and the second bus bar 15*b*, and it is thus possible to prevent a short circuit between the first bus bar 15*a* and the second bus bar 15*b*.

Note that any suitable combination of embodiments or modifications out of the various embodiments or modifications can exhibit their respective effects. Further, a combination of the embodiments, a combination of the examples, or a combination of an embodiment and an example are possible, and a combination of features in different embodiments or examples are also possible.

While the present disclosure has been fully described in connection with preferred embodiments with reference to the accompanying drawings, various variations and modifications will be apparent to those skilled in the art. Such variations and modifications are to be understood as included within the scope of the present disclosure as set forth in the appended claims.

INDUSTRIAL APPLICABILITY

The connection unit according to the present disclosure is also applicable to a connection unit including either a direct current or alternating current electromagnetic relay.

DESCRIPTION OF SYMBOLS

1, 1*a*, 1*b*, 1*c*, 1*d*, 1*e*, 1*f* connection unit
3 battery
5 motor
7 inverter
8 generator
9 capacitor
10 relay
11 resistor
13, 13*a*, 13*b* electromagnetic relay
15 bus bar
15*a* first bus bar
15*b* second bus bar
17 first fixed contact terminal
18 support conductor
18*a* screw hole
18*b* connection end surface
19 first terminal portion
19*a* first fixed contact
19*b* connection end surface
20 second fixed contact terminal
21 support conductor
21*a* screw hole
21*b* connection end surface
22 second terminal portion
22*a* second fixed contact
22*b* connection end surface
24 case
24*a* outer surface
24*b* opening
24*c* outer surface
24*d* opening
24*e* outer surface
24*f* opening
25 screw
26 screw
29 contact mechanism unit
30 electromagnet unit
31 movable shaft
31*a* disk-shaped guard portion
33 movable iron core
35 movable touch piece
35*a* first movable contact
35*b* second movable contact
35*c* center portion
37 contact spring
38 stopper
39 return spring
41 coil
43 spool
43*a* body
45 first yoke
47 second yoke
49 stopper
61 insulating member
63 reinforcing plate
64 hollow hole
65 ring
D section
F electromagnetic repulsive force

The invention claimed is:

1. A connection unit comprising:

an electromagnetic relay; and a bus bar connected to the electromagnetic relay, wherein the electromagnetic relay comprises a case, a first fixed contact terminal fixed to the case, the first fixed contact terminal extending outward from an inside of the case and comprising a first fixed contact, a second fixed contact terminal fixed to the case, the second fixed contact terminal extending outward from the inside of the case and comprising a second fixed contact, and a movable touch piece comprising, on one surface of the movable touch piece, a first movable contact and a second movable contact configured to come into and out of contact with the first fixed contact of the first fixed contact terminal and the second fixed contact of the second fixed contact terminal in a contact-making and breaking direction that is a direction in which the first movable contact and the second movable contact come into or out of contact with the first fixed contact and the second fixed contact, the movable touch piece being disposed in the case and configured to move in the contact-making and breaking direction, the bus bar comprises, outside the case, a first bus bar connected to the first fixed contact terminal, and a second bus bar connected to the second fixed contact terminal, wherein the first bus bar is disposed facing another surface of the movable touch piece located on an opposite side of the movable touch piece from the one surface in the contact-making and breaking direction, with a gap provided between the first bus bar and the movable touch piece in the contact-making and breaking direction, the first bus bar extends in a direction that intersects the contact-making and breaking direction and in which the first movable contact and the second movable contact of the movable touch piece are arranged, and at least part of the first bus bar lies over the movable touch piece in plan view in the contact-making and breaking direction.

2. The connection unit according to claim 1, wherein the first bus bar extends facing, in the plan view, a center portion of the movable touch piece in the direction in which the first movable contact and the second movable contact are arranged.

3. The connection unit according to claim 2, wherein the first bus bar lies over, in the plan view, a whole of the movable touch piece in the direction in which the first movable contact and the second movable contact are arranged.

4. The connection unit according to claim 3, wherein a connection end surface of the first fixed contact terminal connected to the first bus bar and a connection end surface of the second fixed contact terminal connected to the second bus bar protrude outward relative to a first outer surface of the case, and the connection end surface of the first fixed contact terminal and the connection end surface of the second fixed contact terminal relative to a first outer surface of the case are different in height from each other.

5. The connection unit according to claim 3, wherein a connection end surface of the first fixed contact terminal protrudes from a first outer surface of the case and is connected to the first bus bar, and a connection end surface of the second fixed contact terminal protrudes outward of the case from a second outer surface of the case intersecting with the first outer surface and is connected to the second bus bar.

6. The connection unit according to claim 3, wherein the first bus bar is disposed on a first outer surface of the case, the first fixed contact terminal and the second fixed contact terminal are disposed protruding outward of the case from a second outer surface and a third outer surface of the case that intersect with the first outer surface and face each other, and the first fixed contact terminal and the second fixed contact terminal are connected to the first bus bar and the second bus bar.

7. The connection unit according to claim 3, wherein outside the case, an insulating member is disposed between the first bus bar and the second bus bar.

8. The connection unit according to claim 2, wherein a connection end surface of the first fixed contact terminal connected to the first bus bar and a connection end surface of the second fixed contact terminal connected to the second bus bar protrude outward relative to a first outer surface of the case, and the connection end surface of the first fixed contact terminal and the connection end surface of the second fixed contact terminal relative to a first outer surface of the case are different in height from each other.

9. The connection unit according to claim 2, wherein a connection end surface of the first fixed contact terminal protrudes from a first outer surface of the case and is connected to the first bus bar, and a connection end surface of the second fixed contact terminal protrudes outward of the case from a second outer surface of the case intersecting with the first outer surface and is connected to the second bus bar.

10. The connection unit according to claim 2, wherein the first bus bar is disposed on a first outer surface of the case, the first fixed contact terminal and the second fixed contact terminal are disposed protruding outward of the case from a second outer surface and a third outer surface of the case that intersect with the first outer surface and face each other, and the first fixed contact terminal and the second fixed contact terminal are connected to the first bus bar and the second bus bar.

11. The connection unit according to claim 2, wherein outside the case, an insulating member is disposed between the first bus bar and the second bus bar.

12. The connection unit according to claim 1, wherein a connection end surface of the first fixed contact terminal connected to the first bus bar and a connection end surface of the second fixed contact terminal connected to the second bus bar protrude outward relative to a first outer surface of the case, and the connection end surface of the first fixed contact terminal and the connection end surface of the second fixed contact terminal relative to a first outer surface of the case are different in height from each other.

13. The connection unit according to claim 12, wherein outside the case, an insulating member is disposed between the first bus bar and the second bus bar.

14. The connection unit according to claim 1, wherein a connection end surface of the first fixed contact terminal protrudes from a first outer surface of the case and is connected to the first bus bar, and a connection end surface of the second fixed contact terminal protrudes outward of the case from a second outer surface of the case intersecting with the first outer surface and is connected to the second bus bar.

15. The connection unit according to claim 14, wherein the first bus bar is disposed along the first outer surface of the case.

16. The connection unit according to claim 15, wherein outside the case, an insulating member is disposed between the first bus bar and the second bus bar.

17. The connection unit according to claim 14, wherein outside the case, an insulating member is disposed between the first bus bar and the second bus bar.

18. The connection unit according to claim 1, wherein the first bus bar is disposed on a first outer surface of the case, the first fixed contact terminal and the second fixed contact terminal are disposed protruding outward of the case from a second outer surface and a third outer surface of the case that intersect with the first outer surface and face each other, and the first fixed contact terminal and the second fixed contact terminal are connected to the first bus bar and the second bus bar.

19. The connection unit according to claim 18, wherein outside the case, an insulating member is disposed between the first bus bar and the second bus bar.

20. The connection unit according to claim 1, wherein outside the case, an insulating member is disposed between the first bus bar and the second bus bar.

* * * * *